US008584664B2

(12) United States Patent
Sarimurat et al.

(10) Patent No.: US 8,584,664 B2
(45) Date of Patent: Nov. 19, 2013

(54) INDUCER FAN ASSEMBLY FOR A FURNACE

(75) Inventors: Mehmet N. Sarimurat, Fayetteville, NY (US); Peter R. Bushnell, Cazenovia, NY (US); Lee G. Tetu, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 250 days.

(21) Appl. No.: 13/232,506

(22) Filed: Sep. 14, 2011

(65) Prior Publication Data

US 2012/0090600 A1 Apr. 19, 2012

Related U.S. Application Data

(60) Provisional application No. 61/393,473, filed on Oct. 15, 2010.

(51) Int. Cl.
*F24C 3/00* (2006.01)

(52) U.S. Cl.
USPC ..... 126/110 A; 126/85 R; 415/203; 416/185

(58) Field of Classification Search
USPC ..... 126/85 R, 110 A, 99 R; 415/203, 204, 415/206, 225, 226; 416/185, 186 R, 223 B
See application file for complete search history.

(56) References Cited

U.S. PATENT DOCUMENTS 4,334,826 A * 6/1982 Connolly et al. ..... 416/185
5,171,128 A 12/1992 Williamson et al.
5,341,795 A * 8/1994 Chou et al. ..... 126/110 R
5,375,586 A * 12/1994 Schumacher et al. .... 126/110 R
6,537,030 B1 3/2003 Garrison

* cited by examiner

*Primary Examiner* — Alfred Basichas
(74) *Attorney, Agent, or Firm* — Cantor Colburn LLP

(57) ABSTRACT

An inducer fan assembly includes a flow collector piece having a motor support surface, a toroidal collector, and a discharge region extending tangentially from the collector. A fan rotor is rotatably mounted relative to the motor support surface. The fan rotor includes a hub surface, and an outer circumferential edge. The fan rotor further includes a plurality of blades that extend from the hub surface. The plurality of blades extend from a leading edge to a trailing edge that extends beyond the outer circumferential edge. The plurality of blades include a first height and a second height that define a blade tip revolved contour. The collector is arranged radially outward from and axially off-set from the hub surface. An inlet casing piece is mounted to the flow collector piece. The inlet casing piece includes a contour that is substantially similar to the blade tip revolved contour of the fan rotor.

16 Claims, 5 Drawing Sheets

INDUCER FAN ASSEMBLY FOR A FURNACE

CROSS REFERENCE TO RELATED APPLICATION

This is a Non-Provisional Application of Provisional Application Ser. No. 61/393,473, filed Oct. 15, 2010.

BACKGROUND OF THE INVENTION

Exemplary embodiments pertain to the art of furnace systems and, more particularly, to an inducer fan assembly for a furnace system.

Gas furnace systems burn a combustible gas to generate heat. In operation, air is drawn from a comfort region into the furnace. The air from the comfort region is passed through a heat exchanger, heated by the burning combustible gas, and delivered back into the comfort region. A typical heat exchanger includes a series of passages each of which is heated by the burning combustible gas. Products of combustion of the burning combustible gas or flue gas are typically drawn through the passages of the heat exchanger, into a collector box and then discharged to ambient via a chimney or flue pipe through the action of an inducer fan assembly. A typical inducer fan assembly includes a housing, an electric motor, and a centrifugal fan rotor driven by the motor shaft. The housing includes a central inlet, a volute collector region and an outlet port that extends from the collector region.

BRIEF DESCRIPTION OF THE INVENTION

Disclosed is an inducer fan assembly including a flow collector piece including a motor support surface, a substantially toroidal collector, and a discharge region extending substantially tangentially from the collector. The collector forms a central recessed zone in the housing. A fan rotor is rotatably mounted relative to the motor support surface. The fan rotor includes a hub surface, a central region, and an outer circumferential edge. The fan rotor further includes a plurality of blades that extend from the hub surface. The plurality of blades extend from a leading edge at the central region across the hub surface to a trailing edge that extends beyond the outer circumferential edge. The plurality of blades include a first height at the central region and a second height at the circumferential edge. The second height is less than the first height. The first and second heights define a blade tip revolved contour. The collector is arranged radially outward from and axially off-set from the hub surface of the fan rotor. An inlet casing piece is mounted to the flow collector piece. The inlet casing piece includes a central opening that registers with the central region, and an inlet casing contour that is substantially similar to the blade tip revolved contour of the fan rotor.

Also disclosed is a gas furnace system including a heat exchanger, a collector box connected to the heat exchanger, and an inducer fan assembly fluidly connected to the collector box. The inducer fan assembly includes a flow collector piece including a motor support surface, a substantially toroidal collector, and a discharge region extending substantially tangentially from the collector. The collector forms a central recessed zone in the housing. A fan rotor is rotatably mounted relative to the motor support surface. The fan rotor includes a hub surface, a central region, and an outer circumferential edge. The fan rotor further includes a plurality of blades that extend from the hub surface. The plurality of blades extend from a leading edge at the central region across the hub surface to a trailing edge that extends beyond the outer circumferential edge. The plurality of blades include a first height at the central region and a second height at the circumferential edge. The second height is less than the first height. The first and second heights define a blade tip revolved contour. The collector is arranged radially outward from and axially off-set from the hub surface of the fan rotor. An inlet casing piece is mounted to the flow collector piece. The inlet casing piece includes a central opening that registers with the central region, and an inlet casing contour that is substantially similar to the blade tip revolved contour of the fan rotor.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
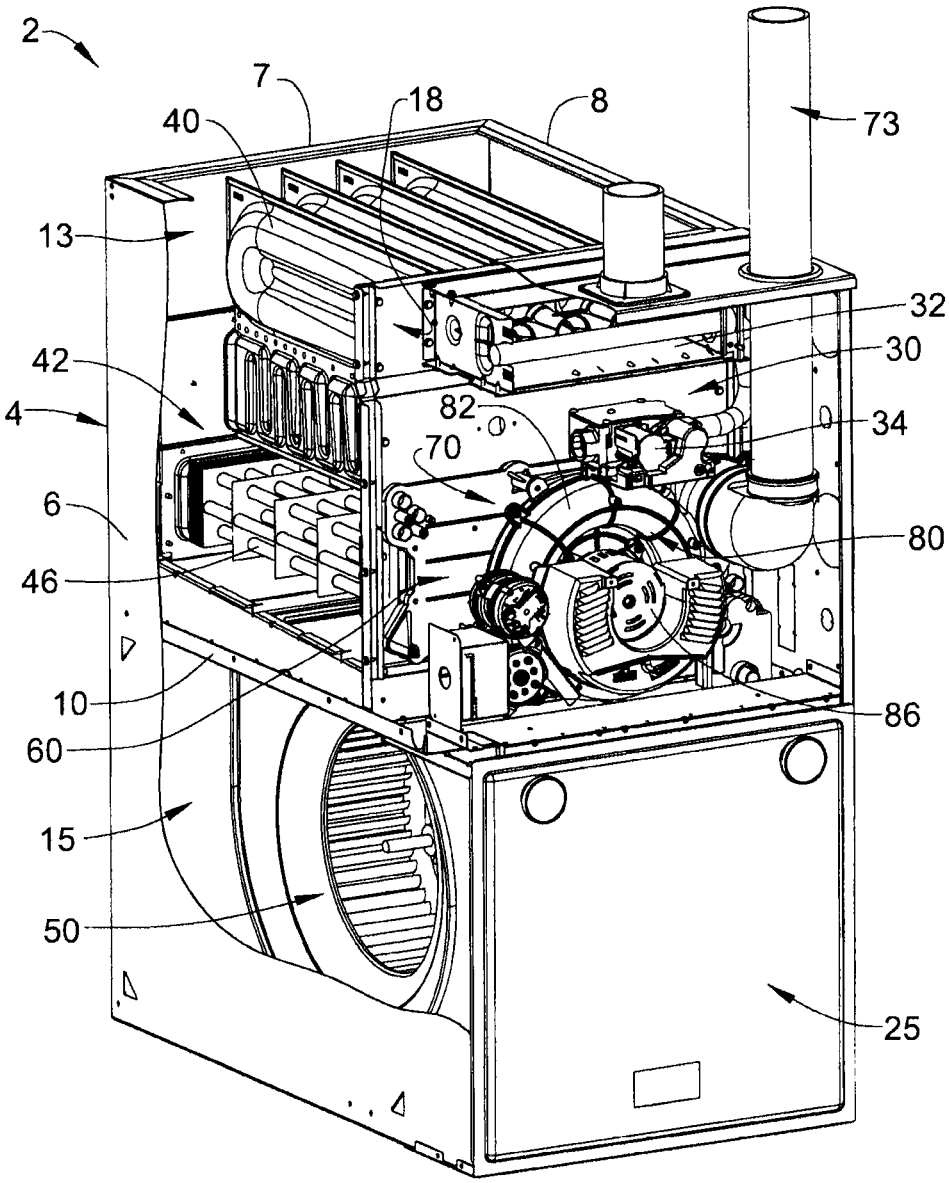
FIG. 1 depicts a gas furnace including an inducer fan assembly in accordance with an exemplary embodiment.

With reference to FIG. 1, a gas furnace system in accordance with an exemplary embodiment is indicated generally at 2. Gas furnace system 2 includes a housing 4 having a plurality of exterior walls 6-8 and an interior dividing wall 10 that forms a heat exchange portion 13 and a blower portion 15. Heat exchange portion 13 includes a component support wall 18 which, as will be discussed more fully below, provides structure for mounting various components of gas furnace system 2. Housing 4 is also shown to include an access panel 25 that provides access to blower portion 15 and another access panel (not shown) that provides access to heat exchange portion 13.

Gas furnace system 2 is also shown to include a burner assembly 30 mounted to component support wall 18. Burner assembly 30 includes a burner box 32 and a gas valve 34. Burner assembly 30 combusts a fuel, in the form of gas to generate heat used to condition a comfort zone such as living spaces, work spaces and the like. Products of combustion or exhaust gases generated by the burning of the fuel are expelled to ambient. In the Exemplary embodiment shown, burner assembly 30 is operatively connected to a primary heat exchanger 40 arranged within heat exchange portion 13. Primary heat exchanger 40 is operatively coupled to a condensing heat exchanger 42. Condensing heat exchanger 42 includes a plurality of heat exchange members 46. With this arrangement, a blower motor assembly 50 arranged within blower portion 15 draws in air from a space to be heated. The air is guided over primary heat exchanger 40, and condensing heat exchanger 42. The air is heated and then re-introduced into the space.

During operation of gas furnace system 2, moisture from the products of combustion condenses in condensing heat exchanger 42. This moisture is collected in a condensate collector system 60 and passed on to an external drain (not shown) Gas furnace system 2 further includes an inducer fan assembly 70 mounted to condensate collector system 60. Inducer fan assembly 70 creates an air flow that draws products of combustion from burner box 32, and through condensate collector system 60. Inducer fan assembly 70 then directs the products of combustion through a flue vent 73. Inducer fan assembly 70 produces a pressure rise and flow rate to achieve a desired combustion performance while overcoming flow losses within gas furnace system 2.

Figure 2:
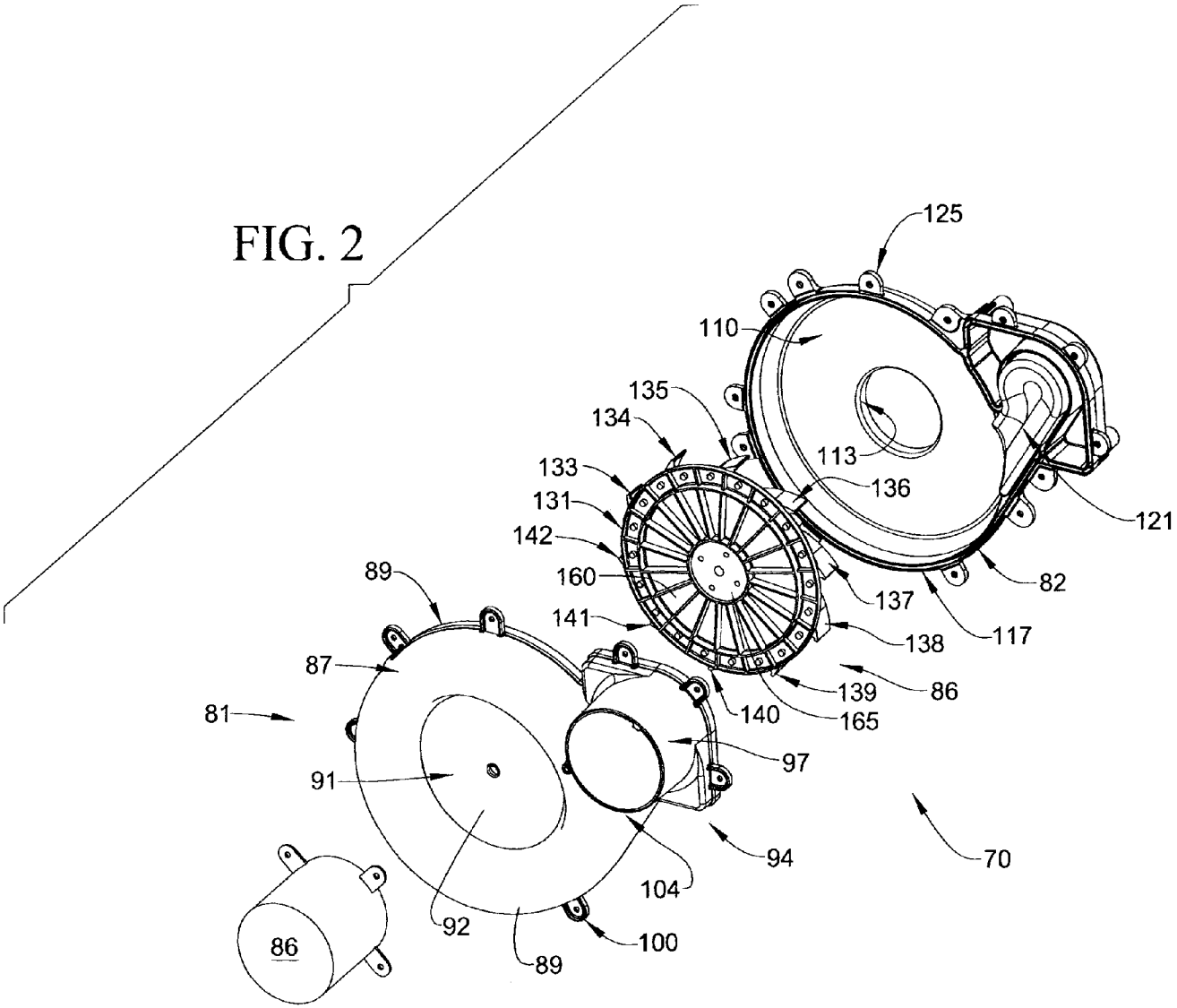
FIG. 2 is an exploded view of the inducer fan assembly of FIG. 1.
Figure 3:
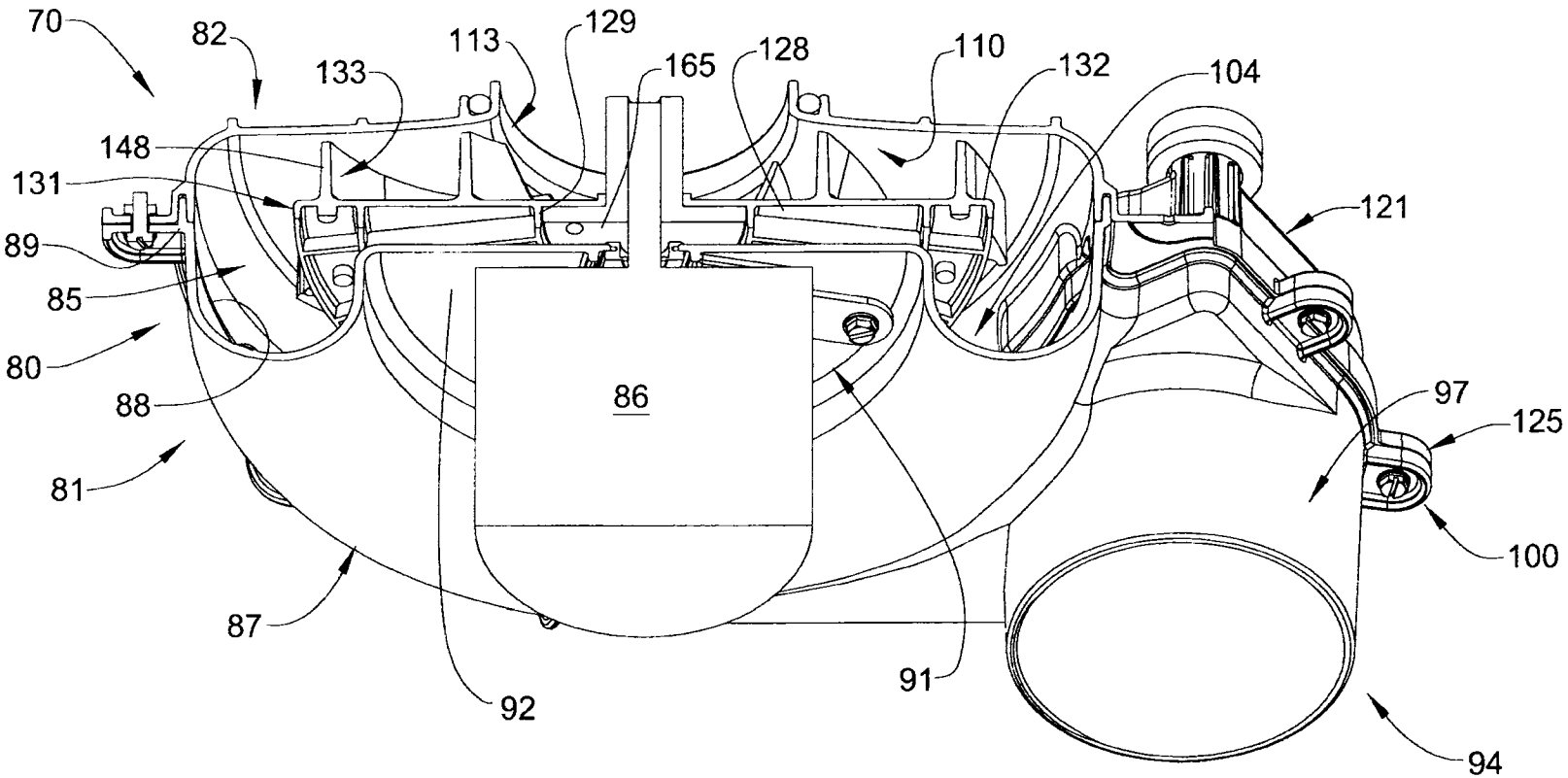
FIG. 3 is a cross-sectional perspective view of the inducer fan assembly of FIG. 1
Figure 4:
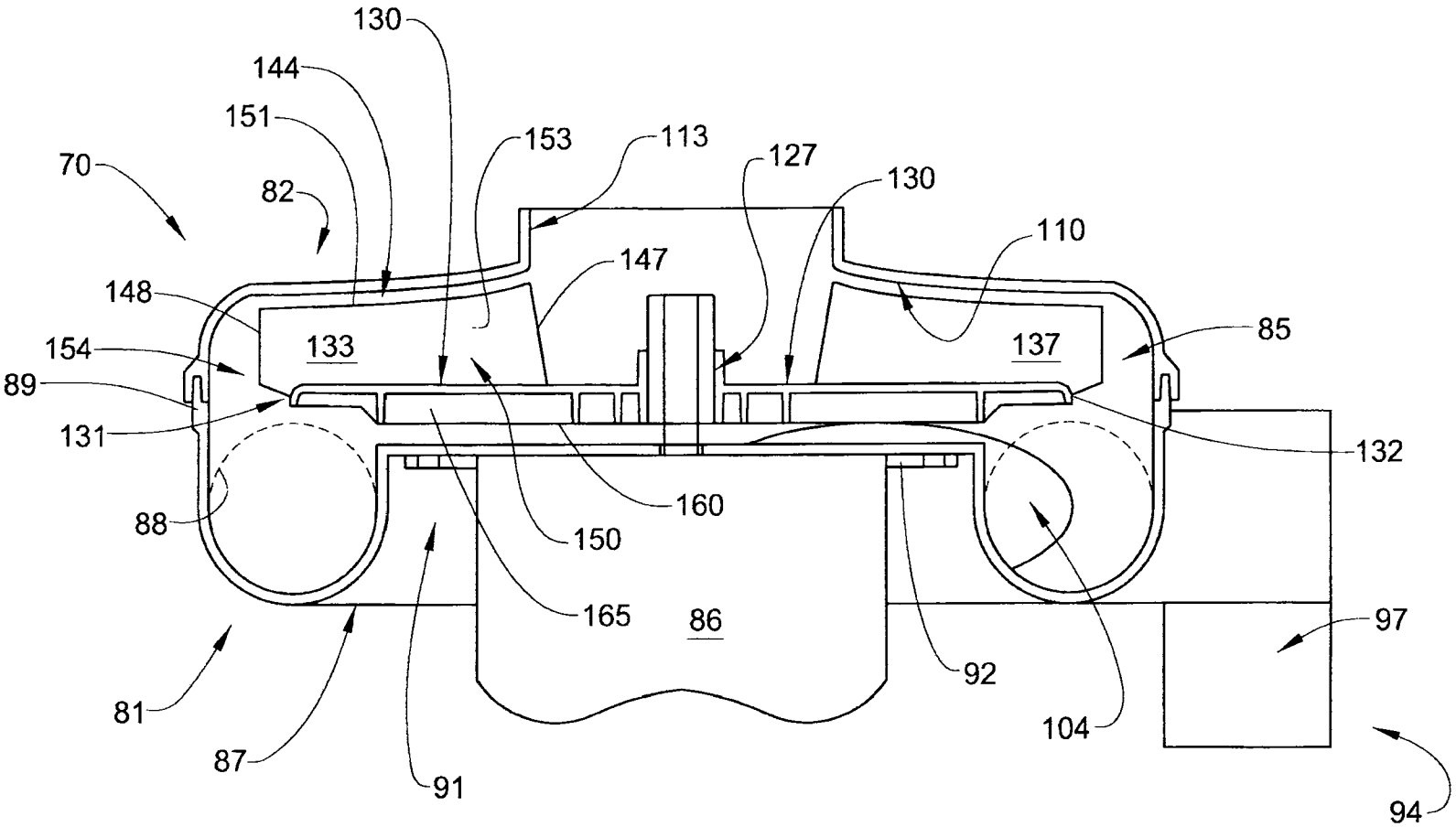
FIG. 4 is a cross-sectional view of the inducer fan assembly of FIG. 1.

As best shown in FIGS. 2-4, inducer fan assembly 70 includes a housing assembly 80 having a housing outlet or flow collector piece 81, a housing inlet or inlet casing piece 82, a fan rotor 85 and a motor 86. Flow collector piece 81 includes a substantially toroidal collector 87 having an inner diameter 88 and a circular rim 89. Collector 87 also includes a central recessed zone 91 that defines a motor support surface 92. With this arrangement, collector 87 is axially off-set from motor support surface 92 and, by extension, relative to fan rotor 85. Flow collector piece 81 is also shown to include a discharge region 94 having a fan outlet 97 and a plurality of mounting members, one of which is indicated at 100. Fan outlet extends substantially perpendicularly from discharge region 94. As shown, discharge region 94 extends substantially tangentially from collector 87. In accordance with the exemplary embodiment, collector 87 includes a collector discharge port 104 having an axial off-set that corresponds to the axial off-set of collector 87. More specifically, collector discharge port 104 is disposed axially off-set from motor support surface 92. In accordance with the exemplary embodiment shown, air guide zone 104 and motor support surface extend along distinct planes that do not overlap.

Inlet casing piece 82 includes an end wall 110 having an inlet opening 113 and a circular rim portion 117. As will be discussed more fully below, end wall 110 includes an inlet casing contour that closely conforms to, or follows a shape of fan rotor 85. More specifically, end wall 110 includes an inlet casing contour that follows a blade revolved profile of fan rotor 85. Inlet casing piece 82 is further shown to include a discharge zone 121 that extends substantially tangentially from end wall 110 and a plurality of mounting elements, one of which is indicated at 125, that extend about circular rim portion 117. Discharge zone 121 is configured to mate with air guide zone 104 on flow collector piece 81 to form a discharge pipe (not separately labeled) Mounting elements 125 register with corresponding ones of mounting members 100 to join flow collector piece 81 with inlet casing piece 82.

Figure 5:
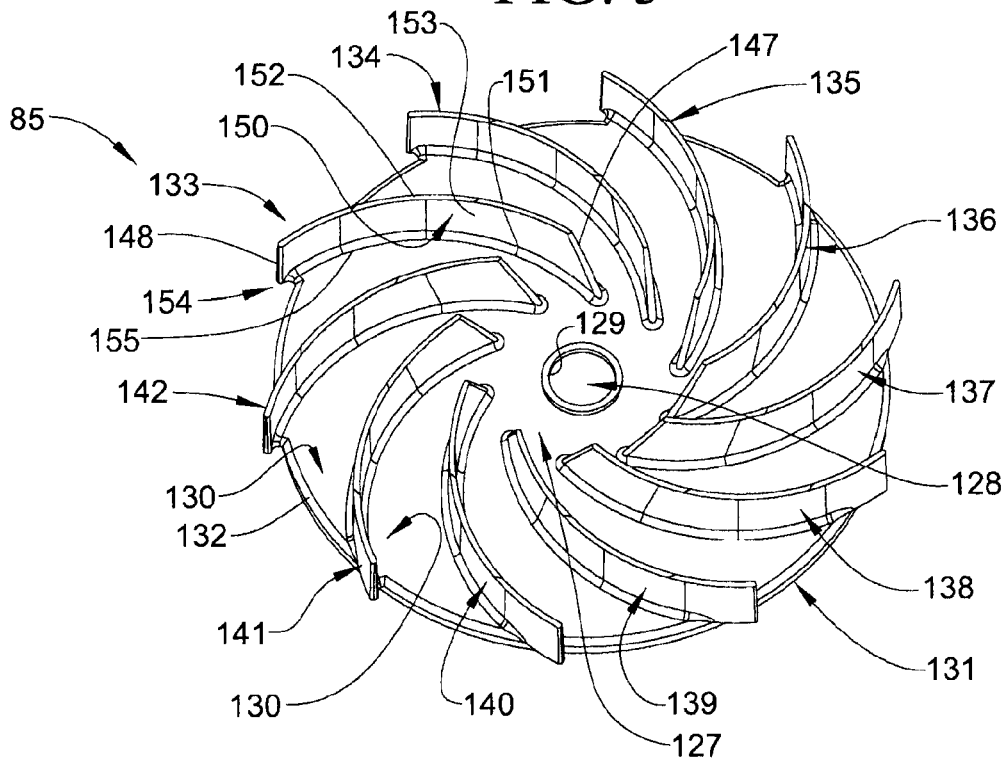
FIG. 5 is a perspective view of a rotor portion of the inducer fan assembly of FIG. 1.
Figure 6:
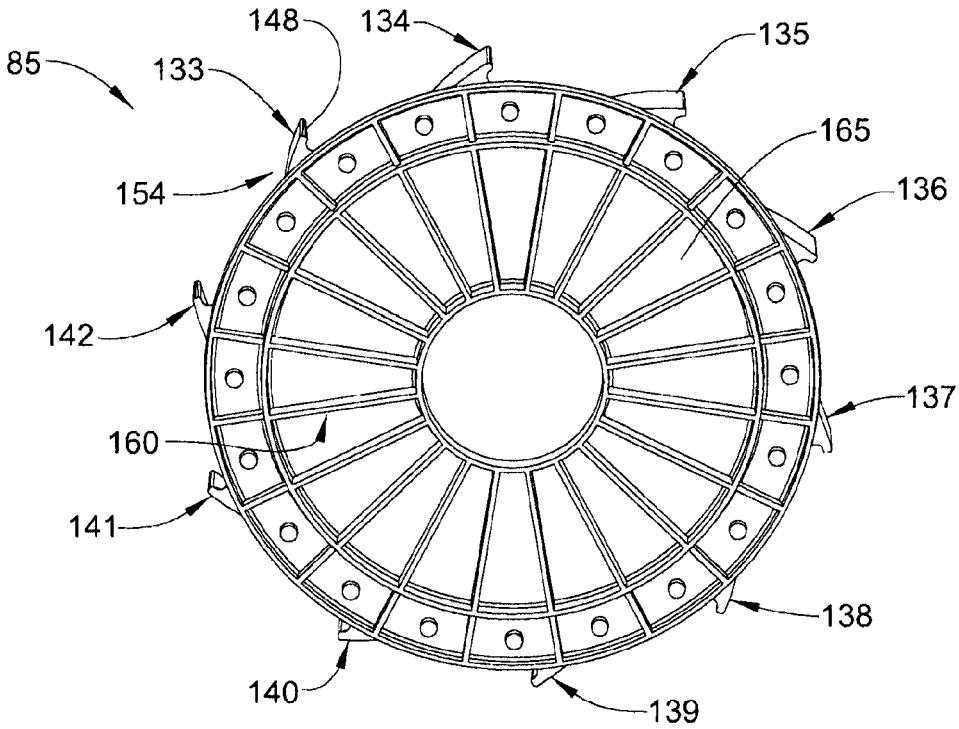
FIG. 6 is a perspective view of an underside of the rotor portion of FIG. 5.

As best shown in FIGS. 5-6, fan rotor 85 includes a hub 127 having a central region 128 provided with an opening 129. Hub 127 extends from central region 128 through a hub surface 130 toward an outer circumferential edge 131 having a slanted or curved zone 132. Fan rotor 85 is further shown to include a plurality of blades 133-142 that extend from hub surface 130. Blades 133-142 include a blade tip revolved contour 144. Blade tip revolved contour 144 closely conforms to the inlet casing contour on inlet casing piece 82 such that fan rotor 85 is devoid of a fan rotor shroud. As each blade is substantially similar, a detailed description will follow referencing blade 133 with an understanding that the remaining blades, i.e. blades 134-142 include corresponding structure.

In the exemplary embodiment shown, blade 133 includes a first end or leading edge 147 that extends to a second end or trailing edge 148 through an intermediate portion 150, and a tip edge 151. Intermediate portion 150 includes a pressure side 152 and a suction side 153. Intermediate portion 150 is backward curved relative to a rotational direction of fan rotor 85. Leading edge 147 is formed having a first height, and trailing edge 148 is formed having a second height that is less than the first height. The first and second heights combine to define blade tip revolved contour 144.

In accordance with one aspect of the exemplary embodiment, trailing edge end 148 extends beyond outer circumferential edge 131 to form a protrusion 154. Blade 133 is also shown to be joined to hub 127 thought a fillet region 155. Fan rotor 85 is also shown to include a plurality of ribs, one of which is shown at 160, formed on an opposing surface 165. Fillet region 155 and ribs 160 provide structural stability for fan rotor 85. Finally, fan rotor 85 is shown to include an insert (FIG. 3) that provides an interface to an electric motor 170. In addition, in accordance with one aspect of the exemplary embodiment, inducer fan assembly 70 is formed such that a ratio between an outer diameter (not separately labeled) of fan rotor 85 as defined by each trailing edge 148 and inner diameter 88 of collector 87 is between about 0.75 and about 0.95. In accordance with another aspect of the exemplary embodiment, inducer fan assembly 70 is formed such that a ratio between outer circumferential edge 131 of fan rotor 85 and an outer diameter (not separately labeled) of fan rotor 85 as defined by each trailing edge 148 is between about 0.85 and about 0.97.

At this point it should be understood that inducer fan assembly 70 has a compact form factor without detracting from an overall operational efficiency. That is, by forming fan rotor 85 without an integral rotating shroud, inducer fan assembly has a lower profile than existing furnace inducer fans. The lower profile leads to greater flexibility in plumbing various outlet options resulting in more compact furnace configurations. The term "axially off-set" should be understood to mean off-set relative to the hub surface of the fan rotor in a direction away from the inlet casing along an axis of rotation of motor 86. Moreover, the axially off-set collector manages rotor outlet flow and formed a recess zone for motor mounting. Furthermore, arranging the collector outlet port axially off-set from the fan rotor leads to a more quiet operation of inducer fan assembly 70. More specifically, the axial off-set reduces unsteady interaction between the rotor blades and any discharge flow passing to the collector outlet port. Reducing the unsteady interaction has been shown to lead to lower sound levels during operation.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A gas furnace system comprising:

a heat exchanger;

a flue coupled to the heat exchanger;

a collector box connected between the heat exchanger and the flue; and an inducer fan assembly fluidly connected to the collector box, the inducer fan assembly including:

a flow collector piece including motor support surface, a substantially toroidal collector, and a discharge region extending substantially tangentially from the collector, the collector forming a central recessed zone in the housing;

a fan rotor rotatably mounted relative to the motor support surface, the fan rotor including a hub surface, a central region, and an outer circumferential edge, the fan rotor further including a plurality of blades extending from the hub surface, the plurality of blades extending from a leading edge at the central region across the hub surface to a trailing edge that extends beyond the outer circumferential edge, the plurality of blades including a first height at the central region and a second height at the circumferential edge, the second height being less than the first height, the first and second heights defining a blade tip revolved contour, wherein, the toroidal collector is arranged radially outward from and axially off-set from at least one of the hub surface of fan rotor and the motor support surface; and an inlet casing piece mounted to the flow collector piece, the inlet casing piece including a central opening that registers with the central region and an inlet casing contour that is substantially similar to the blade tip revolved contour of the fan rotor.

2. The gas furnace system according to claim 1, wherein the inducer fan assembly includes a ratio between an inner diameter of the toroidal collector and an outer diameter of the fan rotor defined by the trailing edge of each of the plurality of blades of between about 0.75 and 0.95.

3. The gas furnace system according to claim 1, wherein the inducer fan assembly includes a ratio between the outer circumferential edge and an outer diameter of the fan rotor defined by the trailing edge of each of the plurality of blades of between about 0.85 and 0.97.

4. The gas furnace system according to claim 1, wherein each of the plurality of blades is backward curved relative to a direction of rotation of the fan rotor.

5. The gas furnace system according to claim 1, further comprising: a fan outlet that extends substantially perpendicularly from the discharge region, the fan outlet being configured and disposed to provide multiple exhaust orientations for the gas furnace.

6. The gas furnace system according to claim 1, wherein the inlet casing piece includes a discharge zone that extends substantially tangentially from end wall.

7. The gas furnace system according to claim 6, wherein the discharge zone and the discharge region combine to define a discharge pipe.

8. The gas furnace system according to claim 1, wherein the toroidal collector is arranged radially outward from and axially off-set from the hub surface of the fan rotor.

9. An inducer fan assembly comprising:

a flow collector piece including motor support surface, a substantially toroidal collector, and a discharge region extending substantially tangentially from the collector, the collector forming a central recessed zone in the housing;

a fan rotor rotatably mounted relative to the motor support surface, the fan rotor including a hub surface, a central region, and an outer circumferential edge, the fan rotor further including a plurality of blades extending from the hub surface, the plurality of blades extending from a leading edge at the central region across the hub surface to a trailing edge that extends beyond the outer circumferential edge, the plurality of blades including a first height at the central region and a second height at the circumferential edge, the second height being less than the first height, the first and second heights defining a blade tip revolved contour, wherein the toroidal collector is arranged radially outward from and axially off-set from at least one of the hub surface of the fan rotor and the motor support surface; and an inlet casing piece mounted to the flow collector piece, the inlet casing piece including a central opening that registers with the central region and an inlet casing contour that is substantially similar to the blade tip revolved contour of the fan rotor.

10. The inducer fan assembly according to claim 9, wherein the inducer fan assembly includes a ratio between an outer diameter of the fan rotor defined by the trailing edge of each of the plurality of blades and an inner diameter of the substantially toroidal collector of between about 0.75 and 0.95.

11. The inducer fan assembly according to claim 10, wherein the inducer fan assembly includes a ratio between the outer circumferential edge and an outer diameter of the fan rotor defined by the trailing edge of each of the plurality of blades of between about 0.85 and 0.97.

12. The inducer fan assembly according to claim 9, wherein each of the plurality of blades is backward curved relative to a direction of rotation of the fan rotor.

13. The inducer fan assembly according to claim 9, further comprising: a fan outlet that extends substantially perpendicularly from the discharge region.

14. The inducer fan assembly according to claim 9, wherein the inlet casing piece includes a discharge zone that extends substantially tangentially from end wall.

15. The inducer fan assembly according to claim 14, wherein the discharge zone and the discharge region combine to define a discharge pipe.

16. The inducer fan assembly according to claim 9, wherein the toroidal collector is arranged radially outward from and axially off-set from the hub surface of the fan rotor.

* * * * *